US012102130B2

(12) United States Patent
Reinitz et al.

(10) Patent No.: US 12,102,130 B2
(45) Date of Patent: Oct. 1, 2024

(54) ELECTRONIC SMOKING DEVICE WITH A LIQUID RESERVOIR THAT ALLOWS THE ADDITION OF ADDITIVES

(71) Applicant: Fontem Holdings 1 B.V., Amsterdam (NL)

(72) Inventors: Timo Reinitz, Hamburg (DE); Ulrike Kowalke, Hamburg (DE)

(73) Assignee: Fontem Ventures B.V., Amsterdam (NL)

( * ) Notice: Subject to any disclaimer, the term of this patent is extended or adjusted under 35 U.S.C. 154(b) by 191 days.

(21) Appl. No.: 15/782,024

(22) PCT Filed: Dec. 7, 2016

(86) PCT No.: PCT/EP2016/080039
§ 371 (c)(1),
(2) Date: Jun. 6, 2018

(87) PCT Pub. No.: WO2017/097821
PCT Pub. Date: Jun. 15, 2017

(65) Prior Publication Data

US 2018/0360113 A1 Dec. 20, 2018

(30) Foreign Application Priority Data

Dec. 9, 2015 (EP) ..... 15198555

(51) Int. Cl.
*A24F 40/485* (2020.01)
*A24B 15/167* (2020.01)
(Continued)

(52) U.S. Cl.
CPC ..... *A24F 40/485* (2020.01); *A24B 15/167* (2016.11); *A24F 40/42* (2020.01);
(Continued)

(58) Field of Classification Search
CPC ..... A24F 40/10; A24F 40/20; A24F 40/30; A24F 40/40; A24F 40/42; A24F 40/48;
(Continued)

(56) References Cited

U.S. PATENT DOCUMENTS

2008/0276948 A1 11/2008 Gedevanishvili et al.
2010/0126505 A1* 5/2010 Rinker ..... A24F 47/002 128/202.21
(Continued)

FOREIGN PATENT DOCUMENTS

CN 102106611 A 6/2011
CN 103263083 A 8/2013
(Continued)

OTHER PUBLICATIONS

European Patent Office; Examination Report issued in counterpart application EP 15198555.3; Date of Report Dec. 7, 2023.

*Primary Examiner* — Eric Yaary
*Assistant Examiner* — Yana B Krinker
(74) *Attorney, Agent, or Firm* — Dykema Gossett PLLC

(57) ABSTRACT

An electronic smoking device (210) is provided including a power supply (18), a liquid reservoir (34) storing a liquid, and an atomizer (26) adapted to atomize liquid stored in the liquid reservoir (34) when operated by the power supply (18). The liquid reservoir (34) is configured to allow addition of additives (50) to liquid stored in the liquid reservoir (34).

15 Claims, 5 Drawing Sheets

(51) Int. Cl.
*A24F 40/42* (2020.01)
*A24F 15/015* (2020.01)
*A24F 40/10* (2020.01)
*A24F 40/20* (2020.01)

(52) U.S. Cl.
CPC ..... *A24F 15/015* (2020.01); *A24F 40/10* (2020.01); *A24F 40/20* (2020.01)

(58) Field of Classification Search
CPC ..... A24F 40/485; A24F 47/002–008; A24F 15/015; A61M 15/06
See application file for complete search history.

(56) References Cited

U.S. PATENT DOCUMENTS

2013/0263869 A1 10/2013 Zhu
2014/0076310 A1 3/2014 Newton
2014/0360514 A1* 12/2014 Zhu ..... A24F 47/008 131/329
2015/0136124 A1 5/2015 Aronie et al.
2015/0157053 A1* 6/2015 Mayor ..... A24F 47/008 131/329

FOREIGN PATENT DOCUMENTS

CN 103960785 A 8/2014
CN 104284606 A 1/2015
CN 204466908 U 7/2015
CN 204742643 U 11/2015
CN 105962422 A 9/2016
EP 3155907 A1 4/2017
WO 2013/152873 A1 10/2013
WO 2014195859 A2 12/2014
WO 2015/052192 A1 4/2015
WO 2016156413 A1 10/2016

* cited by examiner

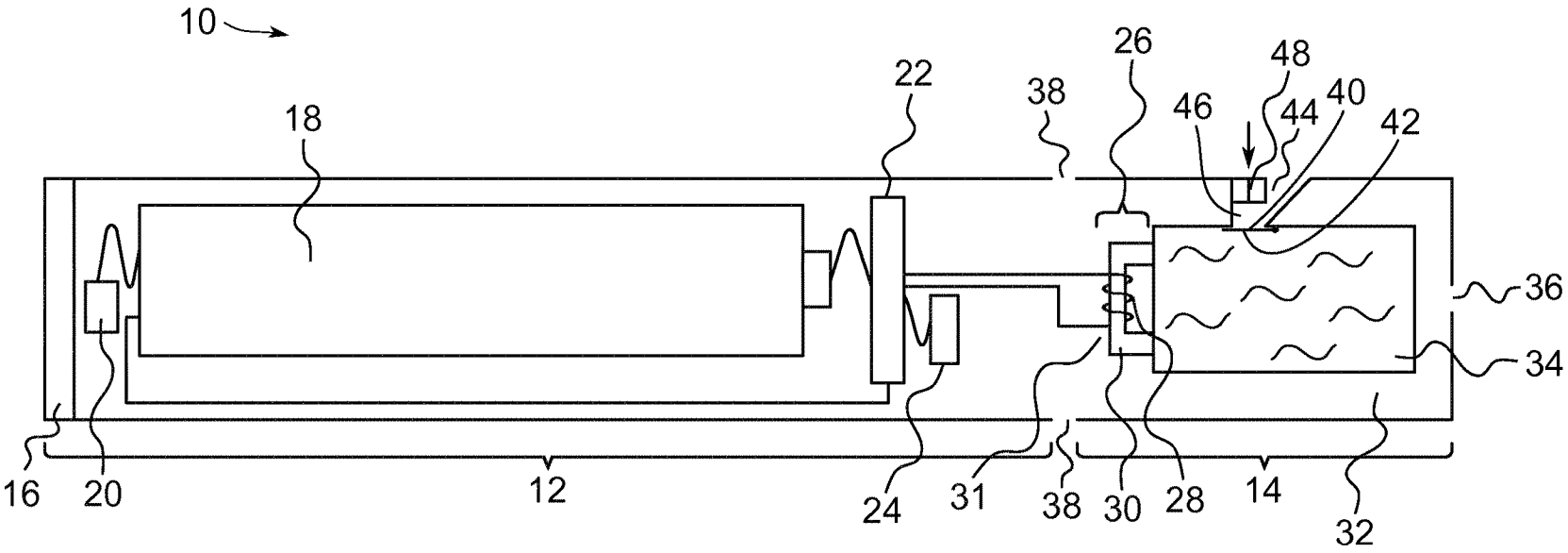
Fig. 1
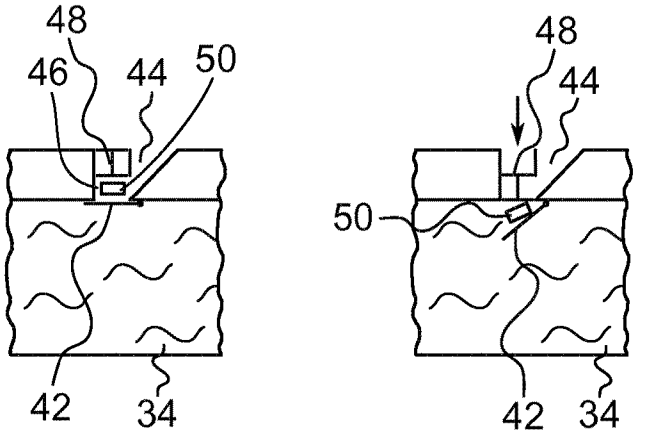
Fig. 2A
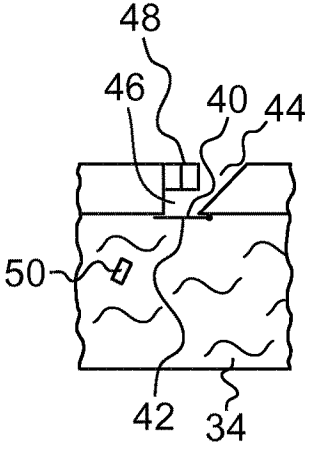
Fig. 2B
Fig. 2C

ELECTRONIC SMOKING DEVICE WITH A LIQUID RESERVOIR THAT ALLOWS THE ADDITION OF ADDITIVES

CROSS-REFERENCE TO RELATED APPLICATIONS

This application is a National Stage Entry application of International patent application no. PCT/EP2016/080039, filed 12 Jul. 2016 and published under International publication no. WO/2017/097821A1 on 15 Jun. 2017 (the '039 application). This application claims priority to European patent application no. 15198555.3, filed 9 Dec. 2015 and published under European publication no. EP3178334 (the '55.3 application). The '039 application and the '55.3 application are hereby incorporated by reference as though fully set forth herein.

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

The smoking experience can be individualized by adding additives to the liquid, e.g. in order to customize the liquid with respect to a preferred flavor.

SUMMARY OF THE INVENTION

In accordance with one aspect of the present invention there is provided an electronic smoking device comprising a power supply, a liquid reservoir storing a liquid, and an atomizer adapted to atomize liquid stored in the liquid reservoir when operated by the power supply. The liquid reservoir is configured to allow addition of additives to liquid stored in the liquid reservoir.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views:

FIG. 1 is a schematic cross-sectional illustration of an exemplary e-cigarette according to a first embodiment;

FIGS. 2A to 2C illustrate a process of adding an additive in the form of a pellet to the liquid reservoir of the e-cigarette of FIG. 1;

DESCRIPTION OF THE PREFERRED EMBODIMENTS

Figure 3:
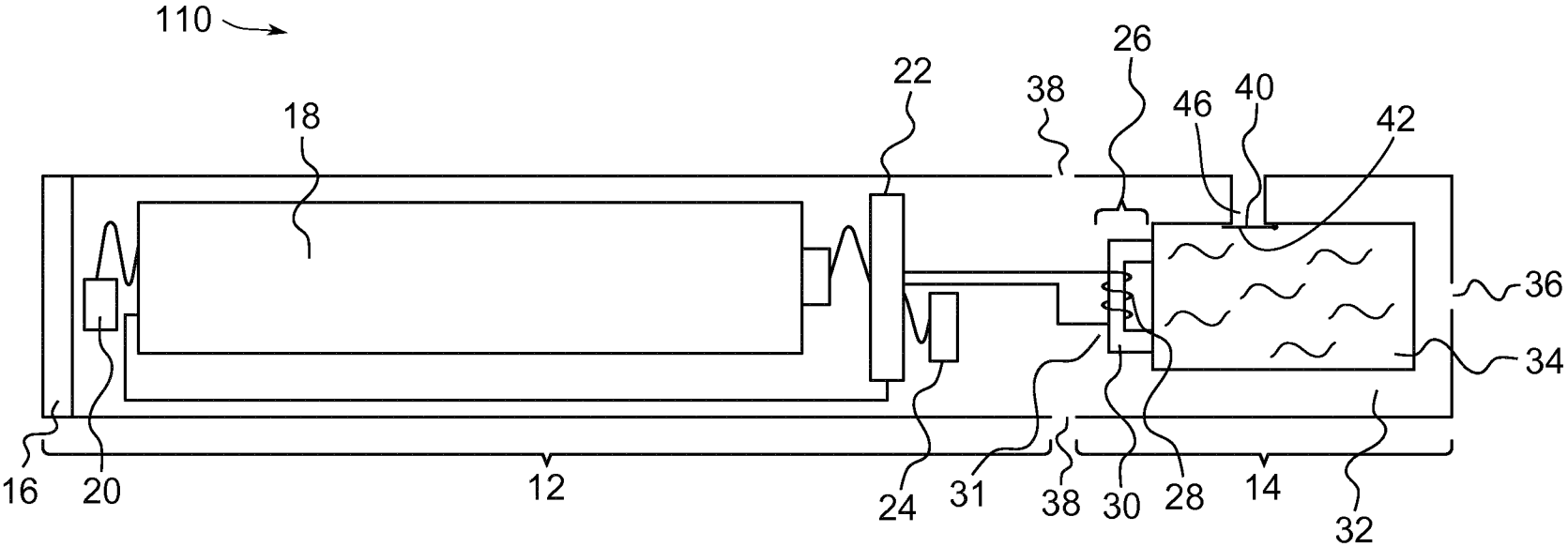
FIG. 3 is a schematic cross-sectional illustration of an exemplary e-cigarette according to a second embodiment.

Throughout the following, an electronic smoking device will be exemplarily described with reference to an e-cigarette. As is shown in FIG. 1, an electronic smoking device 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14. Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 28 mm.

The power supply portion 12 and atomizer/liquid reservoir portion 14 are typically made of metal, e.g. steel or aluminum, or of hardwearing plastic and act together with the end cap 16 to provide a housing to contain the components of the electronic smoking device 10. The power supply portion 12 and an atomizer/liquid reservoir portion 14 may be configured to fit together by a friction push fit, a snap fit, or a bayonet attachment, magnetic fit, or screw threads. The end cap 16 is provided at the front end of the power supply portion 12. The end cap 16 may be made from translucent plastic or other translucent material to allow an LED 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A battery 18, a light-emitting diode (LED) 20, control electronics 22 and optionally an airflow sensor 24 are provided within the cylindrical hollow tube battery portion 12. The battery 18 is electrically connected to the control electronics 22, which are electrically connected to the LED 20 and the airflow sensor 24. In this example the LED 20 is at the front end of the power supply portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the electronic smoking device 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending into an atomizing chamber 31 which is in communication with an air flow passage 32 of the atomizer/liquid reservoir portion 14. The coil 28 may be positioned anywhere in the atomizing chamber 31 and may be transverse or parallel to the liquid reservoir 34. The wick 30 and heating coil 28 do not completely block the atomizing chamber 31. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Non-resistance atomizing elements such as sonic, piezo and jet spray may also be used in the atomizer in place of the heating coil.

The air flow passage 32 passes a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the electronic smoking device 10. This causes air to be drawn into the electronic smoking device 10 via one or more air inlets, such as air inlets 38, and to be drawn through the atomizing chamber 31 and the air flow passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the atomizing chamber 31. As the user continues to suck on the electronic smoking device 10, this aerosol is drawn through the air flow passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some electronic smoking devices are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the electronic smoking device 10 is detachable from the battery portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The liquid reservoir 34 is configured to allow addition of additives to liquid stored in the liquid reservoir 34. To this end, the liquid reservoir 34 comprises an opening 40 which, in an additive adding mode, is configured to let pass additives 50 into the liquid reservoir 34, e.g. additives in the form of solid material, such as pellets 50, globules or the like (cf. FIG. 2A to 2C). In a normal mode, i.e. when no additives 50 are actively added to the liquid reservoir 34, the opening 40 is closed by an appropriate sealing element 42, such as a check valve 42 shown in FIG. 1 and FIGS. 2A to 2C. The sealing element 42, in the normal mode, closes the opening 40 so as to prevent liquid discharging from the liquid reservoir 34 and, in the additive adding mode, allows additives to be added to the liquid reservoir 34 through the opening 40.

By allowing additives to be added to the liquid reservoir 34, individualization of the liquid stored in the liquid reservoir is rendered possible. By adding specific additives, a user of the electronic smoking device 10 can thus customize his smoking experience, e.g. with respect to flavor, odor, color, etc. of the atomized liquid.

The additives may comprise or consist of flavoured material. Said flavoured material, which may be added to the liquid in the liquid reservoir 34, may be selected from esters, such as isoamyl acetate, linalyl acetate, isoamyl propionate, linalyl butyrate and the like; natural essential oils as plant essential oils, such as spearmint, peppermint, *cassia*, jasmine and the like; animal essential oils, such as musk, amber, civet, castor and the like; simple flavouring materials, such as anethole, limonene, linalool, eugenol and the like; hydrophilic flavour components such as a leaf tobacco extract; natural plant flavouring materials such as licorice, St. John's wort, a plum extract, a peach extract and the like; acids such as a malic acid, tartaric acid, citric acid and the like; sugars such as glucose, fructose, isomerized sugar and the like; polyhydric alcohols such as propylene glycol, glycerol, sorbitol and the like. It is also possible to combine at least two different flavoured materials as mentioned above into a new flavoured material.

The flavoured material may be adsorbed onto a solid material and this material is used as flavoured material within an electronic smoking device according to the present invention. Suitable solid materials are generally solid at room temperature and melt when the liquid is heated up. Further, the materials to be used should be at least food-grade and suitable for inhalation in case they at least partially transfer into the aerosol generated by the atomizer. Still further, the respective materials must not form degradation compounds when heated up or undergo any chemical reaction with flavour, nicotine, propylene glycol (PG), or vegetable glycerin (VG). Suitable solid materials that satisfy these constraints can e.g. be found within wax-based materials from sugar-cane, carnauba, shellac, or resin.

The electronic smoking device 10 is specifically configured to allow addition of additives in the form of solid materials, such as pellets or globules. Compared to liquid additives or additives in the form of a powder, pellets or globules have the advantage of simple dosing and refill. Further, with solid material additives, there are no leakage problems that may arise with liquid additives. Also, a contact of a respective liquid additive with the hand of a user can be avoided by using solid material additives, in particular pellets or globules.

An additive pellet 50 can be supplied by a user of the electronic smoking device 10 through the supply channel 44 (cf. FIG. 1, 2A). The compartment 46 acts as a dosing unit that allows the addition of a predetermined amount of additive, because the size of the compartment 46 allows the reception of exactly one pellet 50. In case of additives in the form of a powder or a liquid, a cup-like dosing unit can e.g. be provided in the compartment in order to allow correct dosing of the respective additive.

The electronic smoking device 10 according to FIG. 1 further comprises an additive supply unit 48 operable by a user of the electronic smoking device 10 in order to actually supply the additives 50 to liquid stored in the liquid reservoir 34. In the example show in FIG. 1, the additive is directly supplied by a user. Alternatively, as described below with reference to FIGS. 3 to 6, additives can also be supplied from a respective additive reservoir provided in the electronic smoking device.

In the example shown in FIG. 1, the additive supply unit 48 is provided in the form of a push button 48. As illustrated with respect to FIG. 2A to 2C, when an additive pellet 50 has been supplied to the compartment 46 through the supply channel 44 (cf. FIG. 2A), by pressing down the button 48, the pellet 50 is pressed against the check valve 42, which, as a consequence, is opened up so as to let pass the pellet 50 into the liquid reservoir 34 (cf. FIG. 2B). As soon as the pellet 50 has passed the opening 50, the check valve 42, which is e.g. spring-loaded, is closed again, thereby closing the opening 40. Also the push button 48 can be spring-biased in order to be moved back to the original position (cf. FIG. 2C). The pellet 50 is adapted to rapidly dissolve in the liquid stored in the liquid reservoir 34. In an embodiment of the invention, the solid additive (pellet 50) is adapted such that at least 25%, more preferably at least 50% and still more preferably at least 75%, of the additive is dissolved in the liquid within 60 seconds, more preferably within 40 seconds and still more preferably within 20 seconds.

It is also possible to form the additive supply unit and the dosing unit in a single dosing and supply unit. With respect to the above-described embodiment, the compartment 46 may e.g. be formed by means of an open box that is fixed to the respective end of the push button 48.

Of course, in addition to the above description of the structure and function of a typical electronic smoking device 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

In FIG. 3, a second embodiment of an electronic smoking device 110 is illustrated in a cross-sectional view. According to this very simple embodiment, in contrast to the embodiment of FIG. 1, no additive supply unit is provided. As already described with respect to FIG. 1, a user of the electronic smoking device 110 can manually supply an additive pellet 50 to the compartment 46. In order to finally add the additive pellet 50 to the liquid reservoir 34, the user can e.g. use his finger instead of the push button 48 shown in FIG. 1 in order to push the additive pellet 50 against the check valve 42 through the opening 40 into the liquid reservoir 34.

Figure 4:
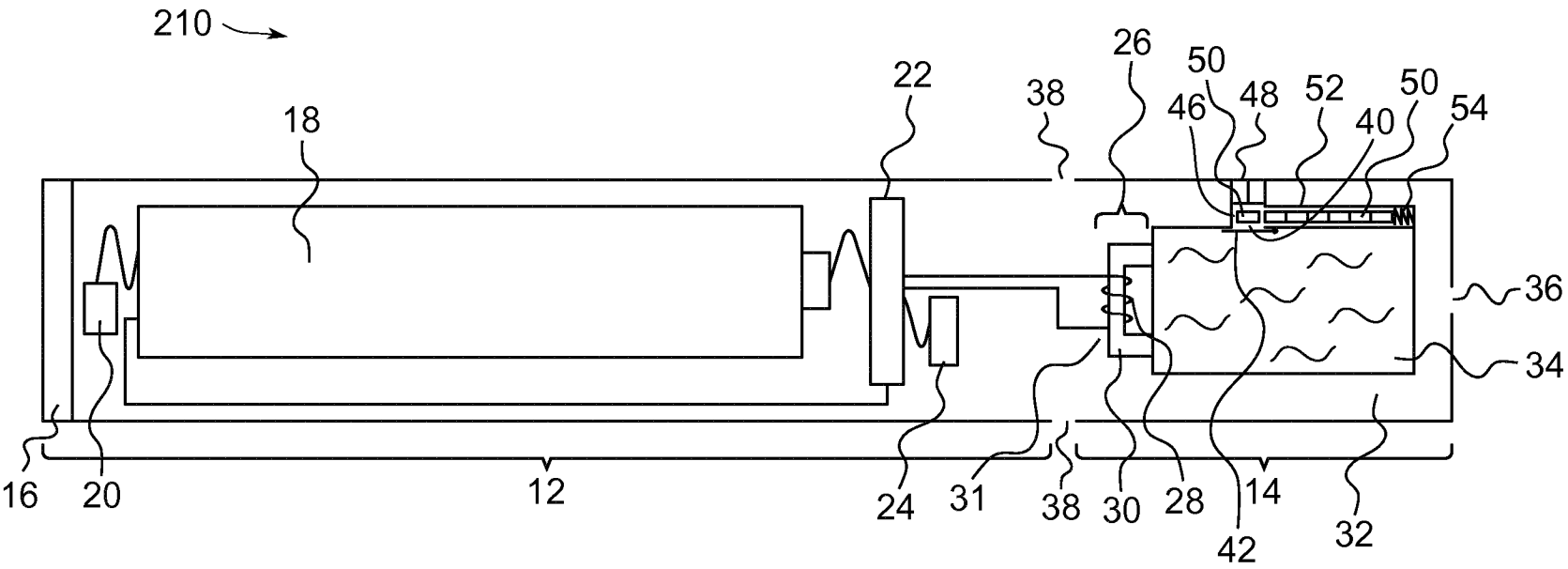
FIG. 4 is a schematic cross-sectional illustration of an exemplary e-cigarette according to a third embodiment.

In FIG. 4, a third embodiment of an electronic smoking device 210 is illustrated in a cross-sectional view. In contrast to the embodiments in FIGS. 1 and 3, the electronic smoking device 210 includes an additive reservoir 52. The additive reservoir 52, which is adapted to store a plurality of solid additive pellets 50, is located outside the liquid reservoir, but forms part of the liquid reservoir portion 14 of the electronic smoking device 210. It is also possible to provide an additive reservoir that is located outside the housing of the electronic smoking device. The additive reservoir 52 is refillable. However, also non-refillable additive reservoirs can be used. In the example shown, the additive reservoir 52 has the form of a channel through which the additive pellets 52 can be supplied to the compartment 46, which again acts as a dosing unit, as described with respect to FIG. 1, e.g. by means of a resilient element 54, which forces the pellets 50 towards the compartment 46. Adding a pellet 50 to the liquid reservoir can be done as described with reference to FIG. 2A to 2C.

Figure 5:
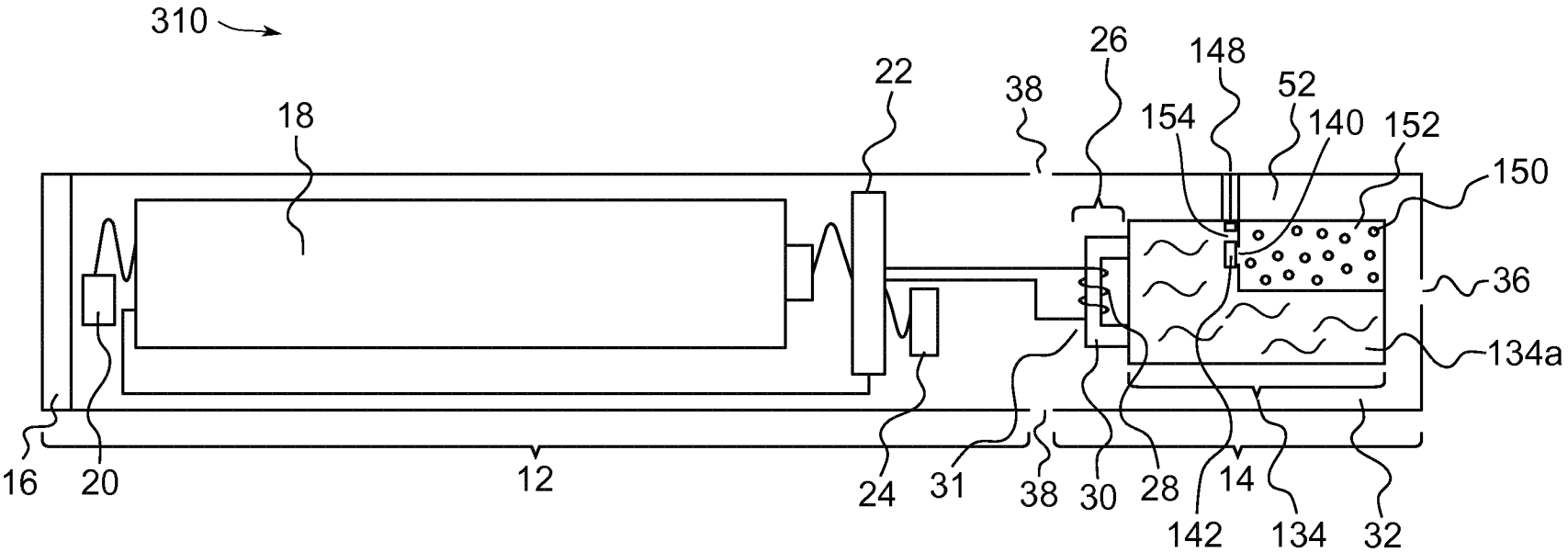
FIG. 5 is a schematic cross-sectional illustration of an exemplary e-cigarette according to a fourth embodiment.

In FIG. 5, a fourth embodiment of an electronic smoking device 310 is illustrated in a cross-sectional view. Also this embodiment includes an additive reservoir 152. However, according to this embodiment, the additive reservoir 152 forms a first chamber in the liquid reservoir 134. A second chamber 134*a* of the liquid reservoir 134, separate from the first chamber 152, stores the liquid. The additive reservoir 152 includes an opening 140 communicating with the second chamber, which opening, in the normal mode, i.e. when no additive is to be added to the liquid in the second chamber, is closed by means of the sealing element 142, which in this example is provided in the form of a movable plate 142. This plate 142 includes an opening 154, which opening can be rendered congruent with the opening 140 of the additive reservoir by pressing the push button 148, thereby allowing solid additive pellets entering the second chamber 134*a*. Also the push button 148 can be spring-biased (not shown) in order to be moved back to the original position, thereby closing the opening 140 of the additive reservoir 152.

Figure 6:
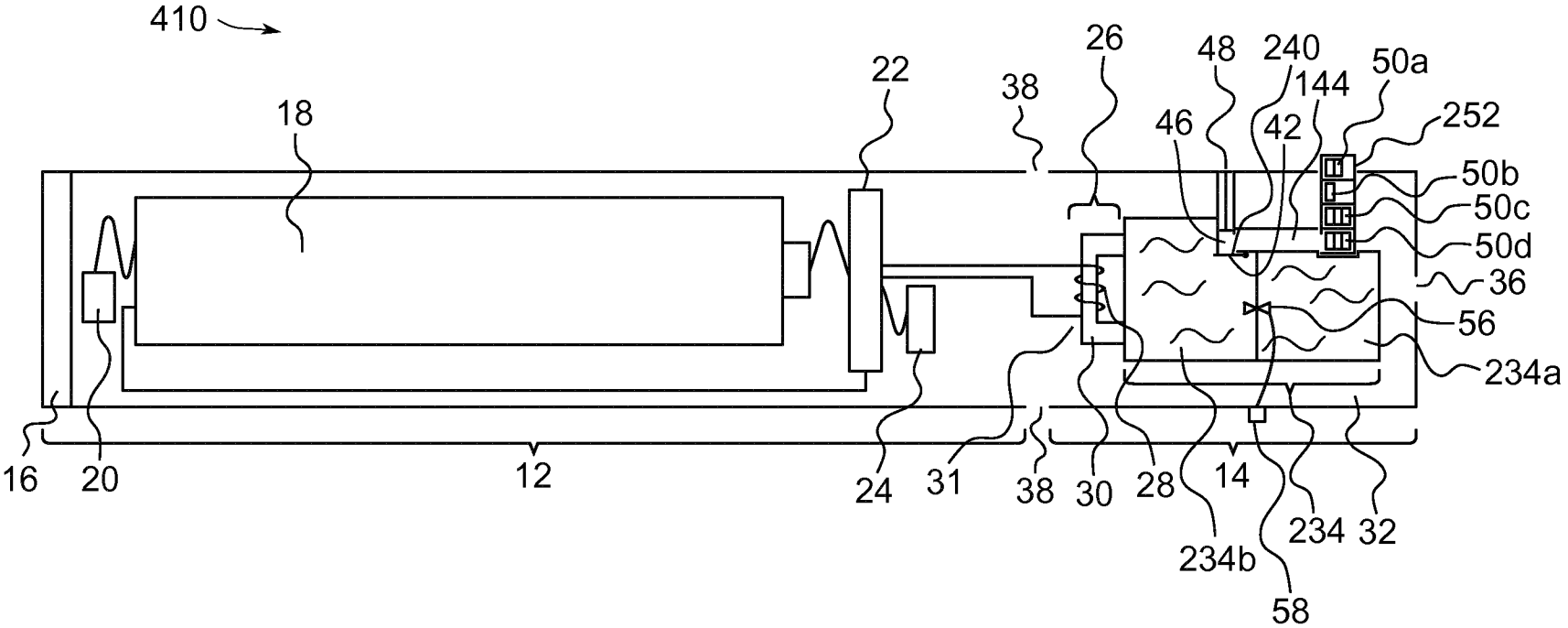
FIG. 6 is a schematic cross-sectional illustration of an exemplary e-cigarette according to a fifth embodiment.

In FIG. 6, a fifth embodiment of an electronic smoking device 410 is illustrated in a cross-sectional view. In contrast to the previous embodiments described above with respect to FIGS. 1 to 5, the liquid reservoir 234 comprises two separate chambers 234*a*, 234*b* that are configured to store liquid. In the first chamber 243*a*, a base liquid is stored. This base liquid corresponds to the liquid stored in the liquid reservoir 34, 134, 134*a* of the previous embodiments—prior to the addition of additives. The base liquid is generally based on propylene glycol (PG) or vegetable glycerin (VG). The second chamber 234*b*, which is in communication with the first chamber 242 via a valve 56 (or another type of closable opening), is configured to receive base liquid from the first chamber 234*a*. The second chamber is called mixing chamber because the liquid stored therein is intended to be mixed with additives added to this liquid. In the previous embodiments described with respect to FIGS. 1 to 5, a single chamber 34, 134, 134*a* plays the role of both the base chamber and the mixing chamber according to the present embodiment.

Providing two separate chambers, one base chamber and one mixing chamber, has the advantage that a predetermined amount of base liquid, i.e. liquid without additives added thereto, can be supplied to the mixing chamber 234*b*, the user can individually mix the liquid in the mixing chamber 234*b*, which may e.g. allow a certain number of puffs, by adding the desired additives. Once this liquid is used up, new base liquid can be supplied to the mixing chamber 234*b* from the base chamber 234*a* and can again individually be customized by adding specific additives. With respect to all embodiments, the chamber originally storing the base liquid can be refillable. However, also closed chamber systems, i.e. system including non-refillable chambers storing the base liquid, can be provided. The mixing chamber according to FIG. 6 is also refillable.

The valve 56 can be operated, i.e. opened and closed, by a user of the electronic smoking device 410, by pressing the button 58 that is operatively connected to the valve 56. By operating the valve 56, a predetermined amount of base liquid can be supplied to the mixing chamber 234*b*. Alternatively, a sealing and opening mechanism as described with reference to FIG. 5 with respect to the opening 140 of the additive reservoir 152 to the liquid chamber 134*a* of the liquid reservoir 134 can be provided in order to allow controlled supply of base liquid from the base chamber 234*a* to the mixing chamber 234*b*.

Also this embodiment according to FIG. 6 includes an additive reservoir 252. In contrast to the additive reservoirs 52, 152 of the embodiments according to FIGS. 4 and 5, the additive reservoir 252 according to FIG. 6, which is provided in the form of a rotating drum, is configured to simultaneously store different kinds of additives 50*a*, 50*b*, 50*d*, 50*c*, which can selectively be added to liquid in the liquid reservoir 234, i.e. in the mixing chamber 234*b* of the liquid reservoir 234. To that end, the rotatable drum comprises a plurality of compartments, each of which being configured to receive a number of additive pellets 50 of a certain kind. By rotating the drum, a user can select a specific kind of additive pellet 50*d* to be added to the mixing chamber 234*b*. The respective pellet can than by supplied through the supply channel 144 to the compartment 46, and can be added to the mixing chamber 234*b* by operating the push button 48 just as described above with respect to FIG. 2A to 2C.

Needless to say that the concept of providing two separate liquid storing chambers, namely a base chamber 234*a* and a mixing chamber 234*b*, as described with respect to FIG. 6, is independent of a usage or a specific type of additive reservoir or additive supply unit. In other words, also in the embodiments described with reference to FIGS. 1 to 5, a base chamber and an separate mixing chamber can be used.

The electronic smoking devices according to the above embodiments allow addition of additives, e.g. flavor pellets, according to the specific desire of a user. Base liquid can thus e.g. be flavored both as regards intensity and specific type of flavor, or modified in an other respect, e.g. with respect to odor and/or color, in an individual manner.

In summary, in one aspect the electronic smoking device has a power supply, a liquid reservoir storing a liquid, and an atomizer adapted to atomize liquid stored in the liquid reservoir when operated by the power supply. The liquid reservoir is configured to allow addition of additives to liquid stored in the liquid reservoir, in particular in order to individualize the liquid and thereby the smoking experience with respect to e.g. flavor, odor, color, etc.

According to an embodiment, the liquid reservoir is configured to allow addition of additives in the form of a solid material, in particular in the form of pellets or globules, which solid material is dissolvable in the liquid stored in the liquid reservoir.

According to an embodiment, the liquid reservoir is configured to allow manual addition of the additives to liquid stored in the liquid reservoir.

According to an embodiment, the electronic smoking device further comprises an additive reservoir for storing additives, which additive reservoir is in communication with the liquid reservoir. The additive reservoir is particularly suited to store additives in the form of pellets or globules.

According to an embodiment, the additive reservoir is adapted to simultaneously store different kinds of additives which can selectively be added to liquid stored in the liquid reservoir. Preferably, the additive reservoir is refillable.

According to an embodiment, the electronic smoking device further comprises an additive supply unit operable by a user of the electronic smoking device in order to supply the additives to liquid stored in the liquid reservoir, directly or from an additive reservoir.

According to an embodiment, the electronic smoking device further comprises a dosing unit that allows addition of a predetermined amount of the additives to the liquid stored in the liquid reservoir.

According to an embodiment, the liquid reservoir comprises a base chamber storing a base liquid. The base chamber is configured to allow addition of the additives to the base liquid stored in the base chamber.

According to an embodiment, the liquid reservoir comprises a base chamber storing a base liquid, and a mixing chamber that is configured to receive base liquid from the base chamber. Supply of a predetermined amount of base liquid to the mixing chamber can be achieved by operation of the user of the electronic smoking device. The mixing chamber is further configured to allow addition of the additives to liquid received from the base tank and than stored in the mixing chamber.

According to an embodiment, the base chamber is refillable.

According to an embodiment, the additives are adapted to modify liquid stored in the liquid reservoir with respect to at least one of flavor, odor, color, or density of the liquid when atomized.

The additives may comprise or consist of flavoured material. Said flavoured material, which may be added to the liquid in the liquid reservoir, may be selected from esters, such as isoamyl acetate, linalyl acetate, isoamyl propionate, linalyl butyrate and the like; natural essential oils as plant essential oils, such as spearmint, peppermint, *cassia*, jasmine and the like; animal essential oils, such as musk, amber, civet, castor and the like; simple flavouring materials, such as anethole, limonene, linalool, eugenol and the like; hydrophilic flavour components such as a leaf tobacco extract; natural plant flavouring materials such as licorice, St. John's wort, a plum extract, a peach extract and the like; acids such as a malic acid, tartaric acid, citric acid and the like; sugars such as glucose, fructose, isomerized sugar and the like; polyhydric alcohols such as propylene glycol, glycerol, sorbitol and the like. It is also possible to combine at least two different flavoured materials as mentioned above into a new flavoured material. The flavoured material may be adsorbed onto a solid material and this material is used as flavoured material within an electronic smoking device according to the present invention.

According to a second aspect, a liquid reservoir for an electronic smoking device is provided, the liquid reservoir stores a liquid that is adapted to be atomized by means of an atomizer of the electronic smoking device when operated by a power supply of the electronic smoking device. The liquid reservoir is configured to allow addition of additives to liquid stored in the liquid reservoir, in particular additives in the form of a solid material, preferably pellets or globules, which solid material is dissolvable in the liquid stored in the liquid reservoir.

According to an embodiment, the liquid reservoir comprises a base chamber storing a base liquid. The base chamber is configured to allow addition of the additives to the base liquid stored in the base chamber.

According to another embodiment, the liquid reservoir comprises a base chamber storing a base liquid, and a mixing chamber that is configured to receive base liquid from the base chamber. Supply of a predetermined amount of base liquid to the mixing chamber can be achieved by operation of the user of the electronic smoking device. The mixing chamber is further configured to allow addition of the additives to liquid received from the base tank and than stored in the mixing chamber.

Preferably, the base chamber is refillable.

According to a third aspect, an atomizer/liquid reservoir portion for an electronic smoking device is provided that includes a liquid reservoir according to the second aspect.

According to a fourth aspect, a cartomizer for an electronic smoking device is provided that includes a liquid reservoir according to the second aspect.

According to preferred embodiments, the atomizer/liquid reservoir portion according to the third aspect and/or the cartomizer according to the fourth aspect respectively comprise at least one of an additive reservoir, an additive supply unit, or an additive dosing unit as described above with respect to the electronic smoking device according to the first aspect.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

10, 110, 210, 310, 410 electronic smoking device
12 power supply portion
14 atomizer/liquid reservoir portion
16 end cap
18 battery
20 light-emitting diode (LED)
22 control electronics
24 airflow sensor
26 atomizer
28 heating coil
30 wick
31 atomizing chamber
32 air flow passage
34, 134, 234 liquid reservoir
36 air inhalation port
38 air inlets
40, 140, 154 opening
42 check valve
44, 144 supply channel
46 compartment
48, 148 push button
50, 50*a*, 50*b*, 50*c*, 50*d*, 150 additive pellet
52, 152, 252 additive reservoir
54 resilient element
56 valve
58 button
134*a*, 234*a* base chamber
142 movable plate
234*b* mixing chamber

The invention claimed is:

1. An electronic smoking device comprising:
a power supply;
a liquid reservoir storing a liquid;
an atomizer adapted to atomize liquid stored in the liquid reservoir when operated by the power supply, wherein the liquid reservoir is configured to allow addition of additives to liquid stored in the liquid reservoir;
an additive reservoir for storing additives, which additive reservoir is in communication with the liquid reservoir;
a dosing unit that allows addition of a predetermined amount of the additives to the liquid stored in the liquid reservoir, per activation of the dosing unit by a user, wherein the predetermined amount is selectable by the user for addition to the liquid stored in the liquid reservoir, wherein the predetermined amount of the additives added to the liquid stored in the liquid reservoir upon activation of the dosing unit is the same per each activation of the dosing unit, and wherein the predetermined amount of the additives is less than all of the additives stored in the additive reservoir, wherein the dosing unit is a channel disposed in a sidewall of the liquid reservoir portion, wherein the dosing unit includes a push button configured to be actuated by a user by depressing the dosing unit in a direction transverse to a central longitudinal axis defined by the liquid reservoir, and wherein the additives include a plurality of pellets disposed in the channel and wherein the dosing unit is configured to dispense one of the plurality of pellets into the liquid reservoir when the push button is depressed.

2. The electronic smoking device according to claim 1, wherein the liquid reservoir is configured to allow addition of additives in the form of a solid material, which solid material is dissolvable in the liquid stored in the liquid reservoir.

3. The electronic smoking device according to claim 2, wherein the liquid reservoir is configured to allow manual addition of the additives to liquid stored in the liquid reservoir.

4. The electronic smoking device according to claim 1, wherein the additive reservoir is adapted to simultaneously store different kinds of additives which can selectively be added to liquid stored in the liquid reservoir.

5. The electronic smoking device according to claim 4, wherein the additive reservoir is refillable.

6. The electronic smoking device according to claim 1, further comprising an additive supply unit operable by a user of the electronic smoking device in order to supply the additives to liquid stored in the liquid reservoir.

7. The electronic smoking device according to claim 6, wherein the liquid reservoir comprises a base chamber storing a base liquid and wherein the base chamber is configured to allow addition of the additives to the base liquid stored in the base chamber.

8. The electronic smoking device according to claim 6, wherein the liquid reservoir comprises a base chamber storing a base liquid, and a mixing chamber that is configured to receive base liquid from the base chamber, wherein the mixing chamber is further configured to allow addition of the additives to liquid stored in the mixing chamber.

9. The electronic smoking device according to claim 8, wherein the base chamber is refillable.

10. The electronic smoking device according to claim 1, wherein the additives are adapted to modify liquid stored in the liquid reservoir with respect to at least one of flavor, odor, color, or density.

11. The liquid reservoir of claim 1, wherein the activation of the dosing unit includes depressing the dosing unit.

12. The liquid reservoir of claim 11, wherein activation of the dosing unit further includes depressing the dosing unit towards the liquid reservoir.

13. The liquid reservoir of claim 12, wherein the dosing unit is spring-loaded.

14. The liquid reservoir of claim 1, further comprising a resilient element configured to force the plurality of pellets towards the dosing unit.

15. The liquid reservoir of claim 1, wherein the dosing unit includes a sealing element, wherein the sealing element is configured to prevent liquid discharging from the liquid reservoir and allows the first pellet to be added to the liquid reservoir.

* * * * *